US006290126B1

(12) United States Patent
Zudal

(10) Patent No.: US 6,290,126 B1
(45) Date of Patent: Sep. 18, 2001

(54) BOX AND SLIDABLE CLOSURE FOR HOLDING BOX TOP FLAPS

(76) Inventor: Andrew Zudal, 4140 Mt. Olney La., Olney, MD (US) 20832

( * ) Notice: Subject to any disclaimer, the term of this patent is extended or adjusted under 35 U.S.C. 154(b) by 0 days.

(21) Appl. No.: 09/588,663

(22) Filed: Jun. 6, 2000

Related U.S. Application Data

(60) Provisional application No. 60/139,490, filed on Jun. 17, 1999, and provisional application No. 60/096,458, filed on Sep. 15, 1998.

(51) Int. Cl.[7] ..... B65D 45/00
(52) U.S. Cl. ..... 229/125.39; 40/312
(58) Field of Search ..... 40/312, 313; 229/125.39, 229/125.41; 24/522, 546, 547, 563, 570, 571, 573.2

(56) References Cited

U.S. PATENT DOCUMENTS 933,454 * 9/1909 Hudson ..... 229/125.39
1,076,897 * 10/1913 Lettre ..... 229/125.39
2,645,408 * 7/1953 Eckles ..... 229/125.39
3,189,250 * 6/1965 Haygeman ..... 229/125.39
3,276,663 * 10/1966 Falconer ..... 229/125.39
3,545,801 * 12/1970 Barsness ..... 229/125.39
4,206,869 * 6/1980 Gurevitz ..... 40/312

FOREIGN PATENT DOCUMENTS

2458725 * 6/1975 (DE) ..... 229/125.39

* cited by examiner

*Primary Examiner*—Gary E. Elkins
(74) *Attorney, Agent, or Firm*—Snider & Associates; Ronald R. Snider

(57) ABSTRACT

A box closure is provided for holding flaps of a box in their downward closed position. The box closure is in a general "H" shape, slides in from one side with a connector which fits in the slot between opposing flaps of a box. The box closure is operative in combination with the box and provides for holding of labels used to identify box contents. The box closure is formed with a single sheet of folded plastic material which is folded to achieve its final shape.

22 Claims, 4 Drawing Sheets

BOX AND SLIDABLE CLOSURE FOR HOLDING BOX TOP FLAPS

This application claims the priority under 35 U.S.C. §119(e) of provisional applications 60/139,490 filed Jun. 17, 1999 and 60/096,458 filed Sep. 15, 1998.

BACKGROUND OF THE INVENTION

1. Field of the Invention

This invention relates to closure of cardboard boxes that are commonly used in industry, in packaging of goods for consumers, and generally in commerce. Cardboard boxes are generally sealed with tape at the flaps to form the bottom and the top of the box. Once the box is opened by cutting or ripping of the tape, the box cannot be easily and quickly reclosed for other use or storage of the contents of the box which is partially consumed.

2. The Prior Art

The prior art utilizes tapes, sticky binders and the like to hold the box flaps together. Tape is used on initial assembly, and later upon resealing of the box. Usually, when the box is reclosed after opening, the flaps are merely bent down in an overlapping fashion to interlink with each other in a crisscross fashion.

When a box is reused, such as for storage by consumers, the box top may also be resealed with any handy tape, string or the like. If it is necessary to utilize a label on the box, the usual procedure is to mark the box with a separate stick on label, or just to write on the box information about its contents.

BRIEF SUMMARY OF THE INVENTION

A box closure for holding opposing flaps of a cardboard box top in a substantially closed position is designed for a box having at least two opposing flaps. The box closure has a first holding member which extends below at least two opposing flaps of the box when the closure is in a closing position, a second holding member which extends over the at least two flaps when the closure is in a closing position, and a means for connecting the first holding member and the second holding member which passes through a space between the opposing flaps of the box. The first holding member, the second holding member, and the means for connecting are an integral unit constructed separately from the box and the box and box closure are assembled only when the box is closed using the box closure. The box closure is formed from a single sheet of plastic or like material and folded and to form its final shape. The closure may also include a means for holding a label which can be a transparent member which extends over an upper surface of the second holding member. The means for connecting may be resilient and pull the first holding member towards the second holding member to accommodate flaps having different thicknesses. The first holding member may extend a greater distance towards the box folds where the flaps join sides of the box, and the first holding member may extend a greater distance than the second holding member in a direction parallel to folds at a point where the adjacent flaps join sides of the box. The means for connecting the first holding member and the second holding member may extend at an angle from a leading edge of the first holding means to a leading edge of the second holding member To facilitate insertion into a slot formed by opposing flaps. The means for holding the label may comprise an oval-shaped box closure top having a center which is open to receive a label for identification of the box or the box contents. The first holding member, the second holding member, the means for connecting the first and second holding members and the means for holding the label may all be preferably formed together from a single sheet of plastic. The plastic is formed into lengths which are equal to or less than a dimension across the box along edges of opposing flaps. The first holding member may be flat on its bottom surface for preventing interference upon insertion by a box flap lying under the two flaps and which is transverse to the opposing flaps. The first holding member may have edges which are curved towards the second holding member for gripping the two opposing flaps. The second holding member may have edges which are curved towards the first holding member for gripping the two opposing flaps or both the first and second members may have edges which extend towards each other.

The box closure is manufactured as a single folded plastic piece, and at least the top portion thereof must be of a clear plastic where it is necessary to view a label through the plastic. Where it is desired to have a tapered leading edge 29, the material can be cut at an angle during production or preformed prior to folding into a final shape. The length of the closure may be any length required for holding flaps of boxes down. Generally, larger boxes would include a longer length because of a need for holding additional length in the flaps.

DETAILED DESCRIPTION OF THE PREFERRED EMBODIMENT

Figure 1:
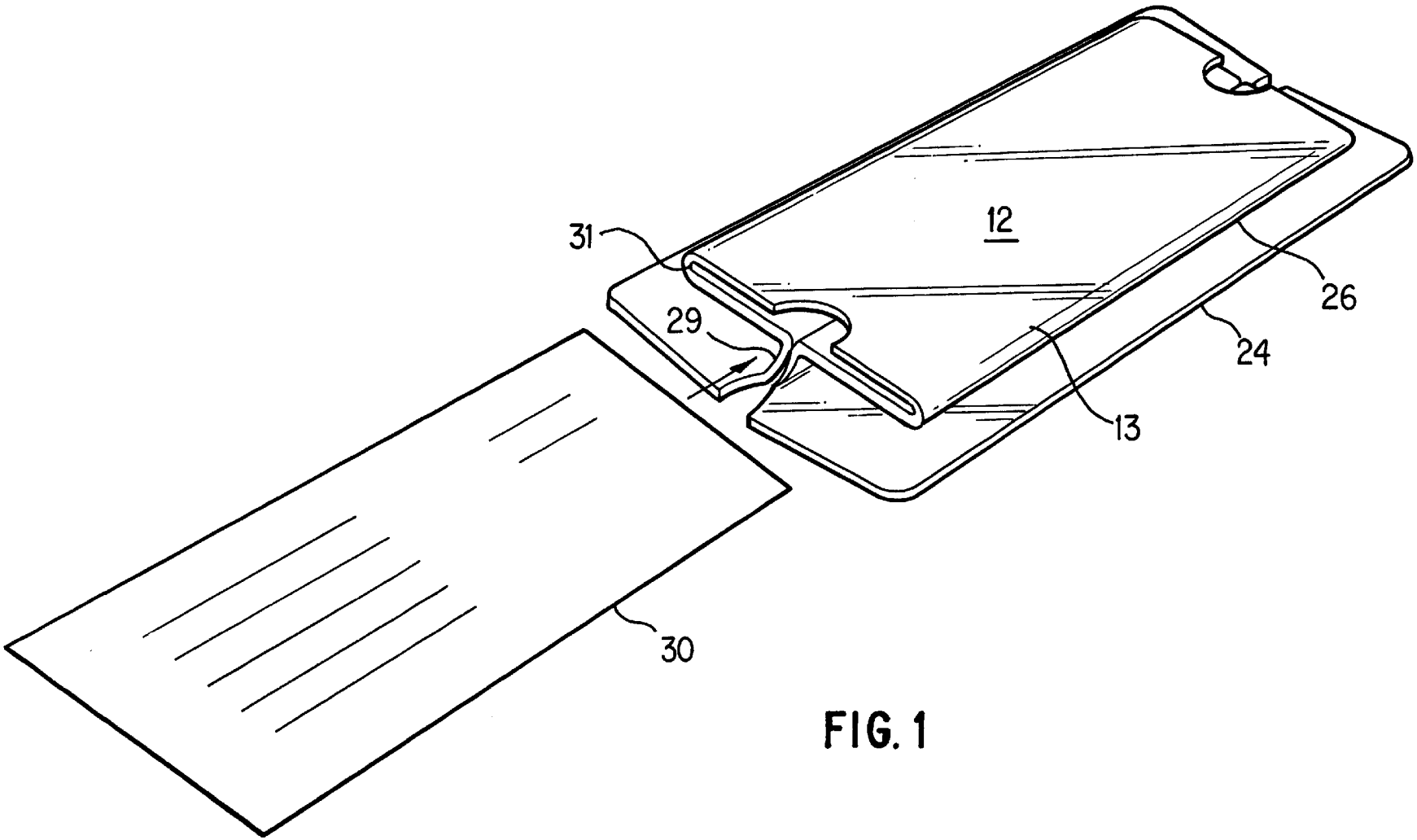
FIG. 1 shows a perspective view of the box closure and a label which may be inserted into an oval space at the top of the closure.
Figure 2:
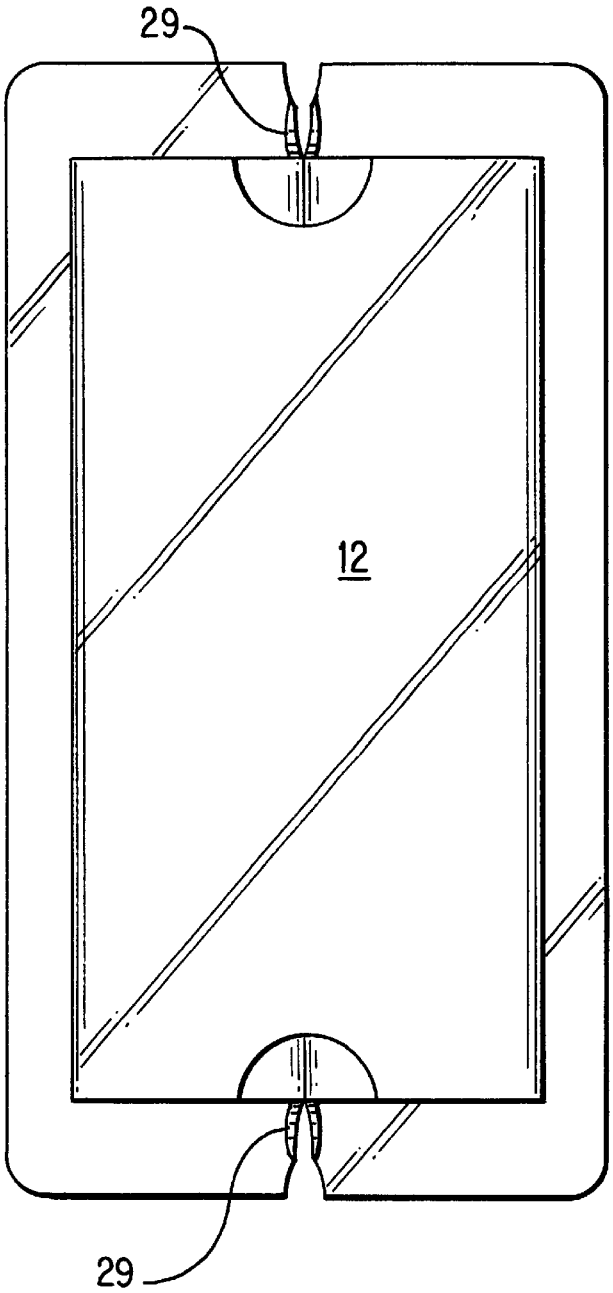
FIG. 2 shows a top view of the closure 12.
Figure 3:
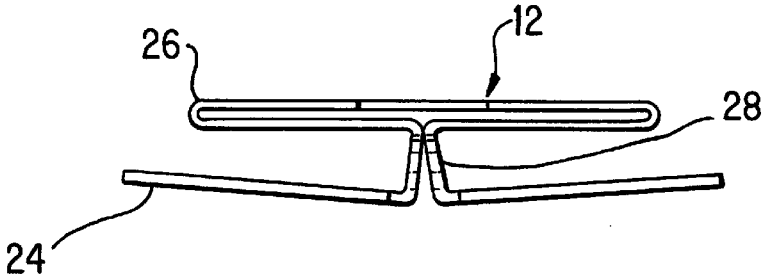
FIG. 3 shows and end view of the closure 12.
Figure 4A:
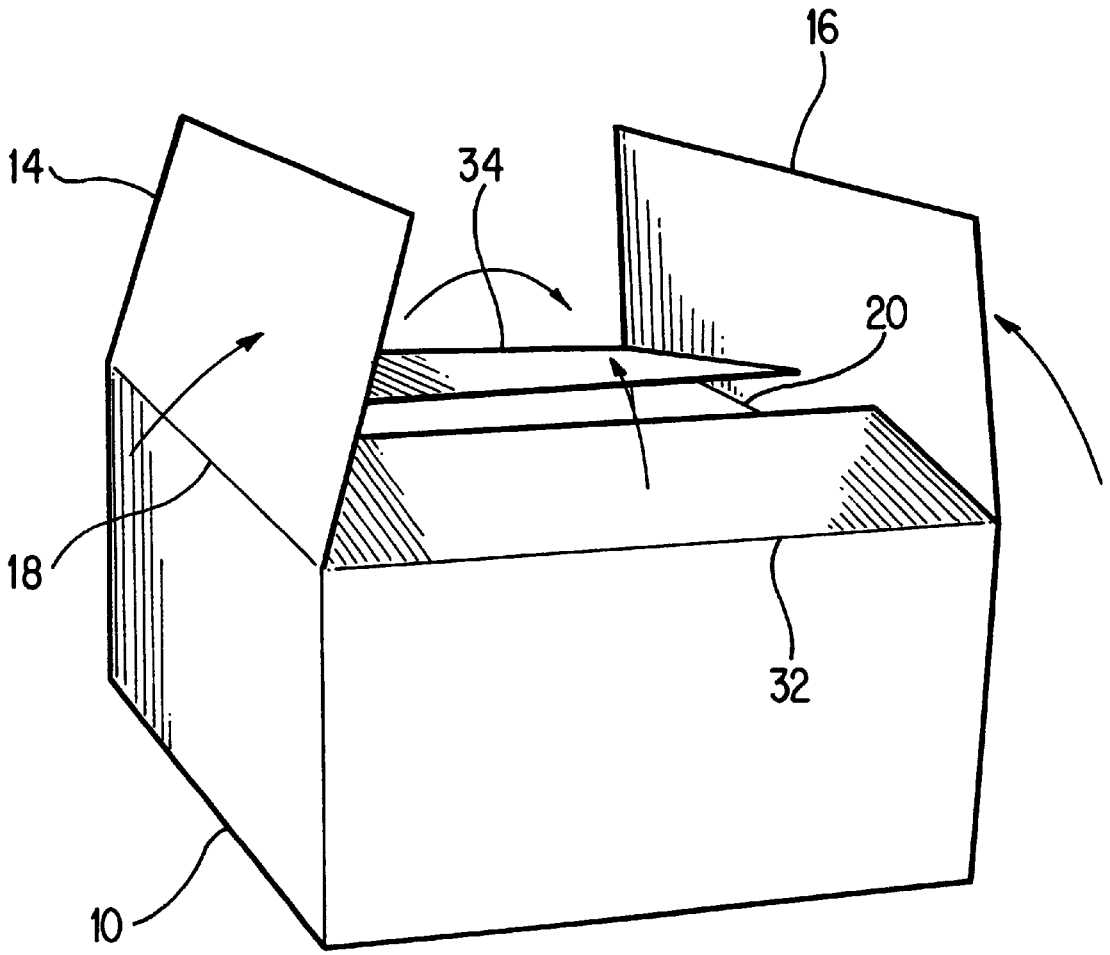
FIG. 4A shows a cardboard box and four flaps at the top which are folded down to form the box top.
Figure 4B:
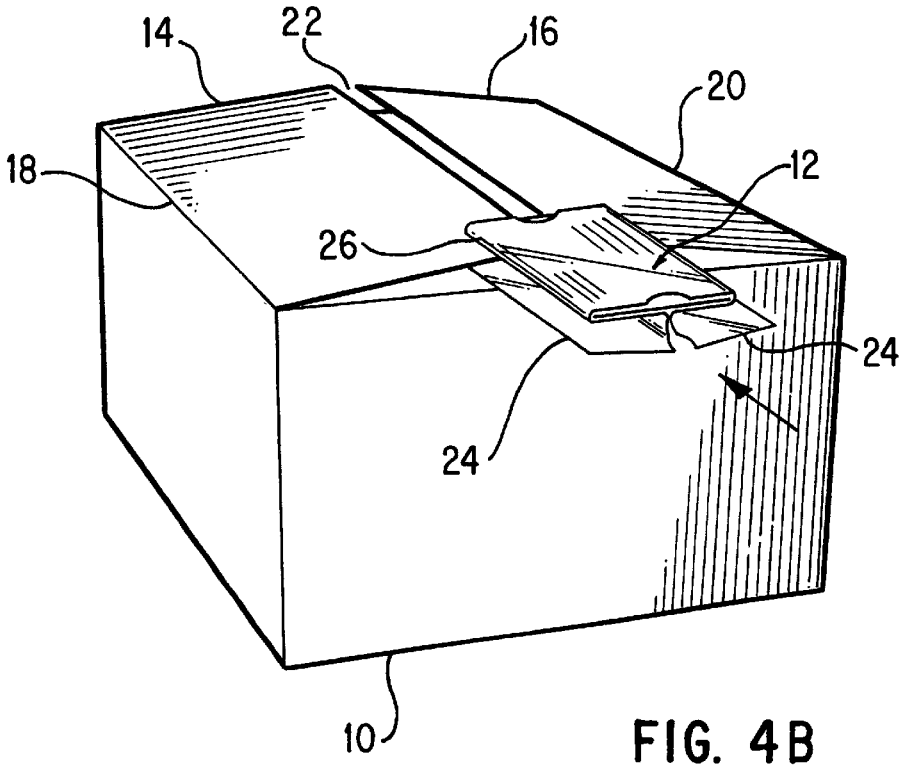
FIG. 4B shows a box where the lids are in a folded position and the closure is being inserted between two lids.
Figure 4C:
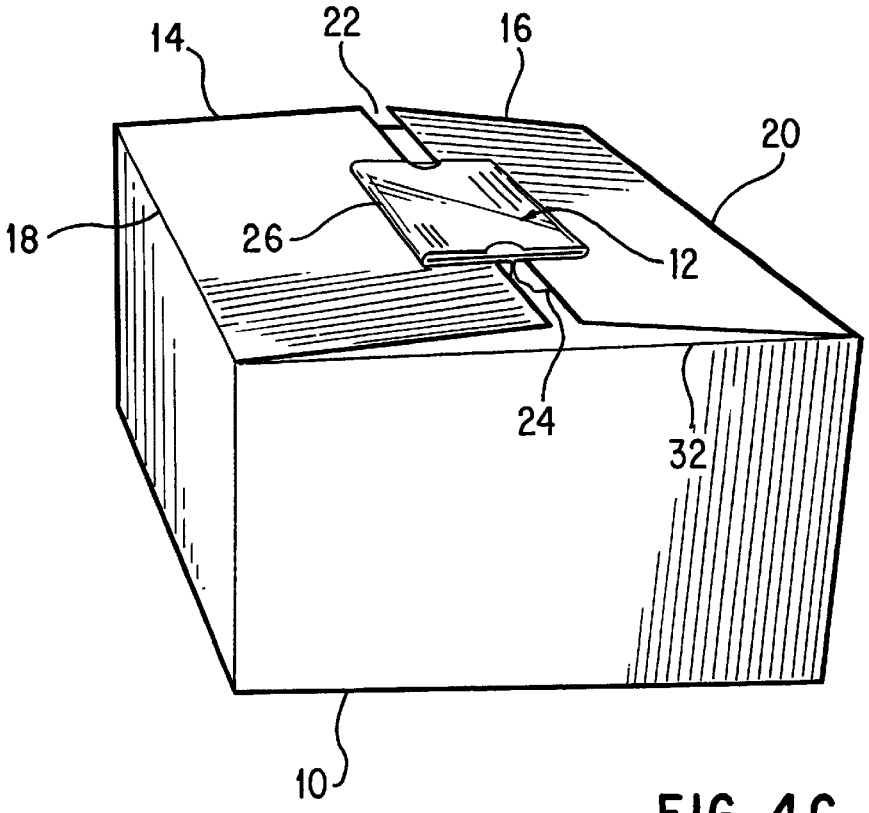
FIG. 4C shows a box where the closure is fully in place securing the lids.

FIGS. 4A and 4B generally shows a box 10 and a box closure 12 of this invention. The box 10 is sealed at the bottom with tape, staples or the like, and the closure of the bottom may be any suitable box closing method or device. The top of the box 10 has at least two opposing flaps 14 and 16 which are conventional. The flaps 14 and 16 are folded respectively at the edges 18 and 20 of the box 10. As is conventional in box construction, there is a slight space 22 between the box opposing flaps 14 and 16 when the flaps are bent in their downward position as shown in FIGS. 4B and 4C. FIGS. 4B and 4C show a first holding member 24 which extends below the flaps 14 and 16. A second holding member 26 is shown on the top surface of the box. Each first holding member 24 is connected to a second holding member 26. This connection as shown as two separate folds 28 of the plastic in FIG. 3. The second holding member 26 may have a slight downward arch for pressing down one of the flaps 16. The first holding member 24 also extends upward towards the second holding member 26, as shown in FIGS. 1 and 3. As generally depicted in FIG. 1, the box closure 12 is adapted to secure the opposing flaps 14 and 16 from both the bottom and the top to prevent the flaps 14 and 16 from flipping upward or opening when the closure is in place. FIG. 1 also includes a label 30 which slides into an oval space 31 formed by holding member 26 and the closure 12 top 13. The label 30 and the means for holding the label 30 can take numerous forms in accordance with this invention.

Referring now to FIG. 4B and 4C, there is illustrated the method for assembly of the box having the two opposing flaps 14 and 16 and the box closure 12. The box closure 12 slips into the slot 22 formed between the edges of opposing flaps 14 and 16 one end. Generally, boxes are also provided with another set of opposing flaps which are perpendicular to flaps 14 and 16 and fold along edges 32 and 34 shown in FIG. 4A. This folded edge 32 provides additional guidance and improves ease of insertion of the box closure 12 in between the flaps 14 and 16 as shown in FIG. 4B.

A tapered leading edge 29 is formed with the folds 28. This tapered leading edge facilitates insertion of the closure 12 into the slot 22.

The closure 12 is prepared by folding a single piece of plastic material in the shape shown in FIGS. 1 to 4. The ends were trimmed prior to folding. The folding process includes the use of heat to make the folds as shown.

The portion of the container closure 12 which slides under the container lids is longer than the portion that is on the top which contains the label. Still further, the portion on the bottom extends slightly upward, as shown in FIGS. 1 and 3, therefore providing a pitch for the box top flap.

What is claimed:

1. A box and box closure for holding opposing flaps of the box top in a closed position the improvement comprising:

a box having at least two opposing flaps;

a first holding member which extends below at least two box opposing flaps when the closure is in a closing position; and a second holding member which extends over the at least two box flaps when the closure is in a closing position;

a means for connecting the first holding member and the second holding member which passes through a space between the two opposing flaps of the box;

wherein the first holding member, the second holding member, and the means for connecting are in an integral unit constructed separately from the box; and wherein the second holding member includes a means for holding a label.

2. A box and box closure in accordance with claim 1, wherein said means for holding a label comprises a transparent member which extends over an upper surface of the second holding member.

3. A box and box closure in accordance with claim 1 wherein the first holding member, the second holding member, and the means for connecting the first and second holding members are all formed together from a continuous material.

4. A box and box closure in accordance with claim 3 wherein the closure is cut into lengths which are equal to or less than a dimension across the box along edges of the opposing flaps.

5. A box and box closure in accordance with claim 3 wherein said material is a plastic.

6. A box and box closure in accordance with claim 1 wherein the first holding member is flat on its bottom surface which prevents interference upon insertion of the closure over and below the two box flaps by a box flap which is transverse to the two opposing flaps.

7. A box and box closure in accordance with claim 6 wherein the second holding member has edges which are closer to the first holding member than a distance between the first and second holding members measured at the means for connecting, for gripping the two opposing flaps.

8. A box and box closure for holding opposing flaps of the box top in a closed position the improvement comprising:

a box having at least two opposing flaps;

a first holding member which extends below at least two box opposing flaps when the closure is in a closing position; and a second holding member which extends over the at least two box flaps when the closure is in a closing position;

a means for connecting the first holding member and the second holding member which passes through a space between the two opposing flaps of the box;

wherein the first holding member, the second holding member, and the means for connecting are in an integral unit constructed separately from the box; and wherein the means for connecting is resilient and pulls the first holding member towards the second holding member, wherein the two opposing flaps have different thickness and are held between the first and second holding members.

9. A box and box closure for holding opposing flaps of the box top in a closed position the improvement comprising:

a box having at least two opposing flaps;

a first holding member which extends below at least two box opposing flaps when the closure is in a closing position; and a second holding member which extends over the at least two box flaps when the closure is in a closing position;

a means for connecting the first holding member and the second holding member which passes through a space between the two opposing flaps of the box;

wherein the first holding member, the second holding member, and the means for connecting are in an integral unit constructed separately from the box;

wherein the first holding member is rectilinear in shape and extends a greater distance towards folds at a point where the flaps join sides of the box than the distance the second holding member extends towards the folds; and wherein the second holding member includes the means for holding a label.

10. A box and box closure for holding opposing flaps of the box top in a closed position the improvement comprising:

a box having at least two opposing flaps;

a first holding member which extends below at least two box opposing flaps when the closure is in a closing position; and a second holding member which extends over the at least two box flaps when the closure is in a closing position;

a means for connecting the first holding member and the second holding member which passes through a space between the two opposing flaps of the box;

wherein the first holding member, the second holding member, and the means for connecting are in an integral unit constructed separately from the box;

wherein the first holding member has edges which are closer to the means for connecting, the second holding member than a distance between the first and second holding members measured at the means for connecting, for gripping the two opposing flaps; and wherein the second holding member includes the means for holding a label.

11. A box and box closure for holding opposing flaps of the box top in a closed position the improvement comprising:

a box having at least two opposing flaps;

a first holding member which extends below at least two box opposing flaps when the closure is in a closing position; and a second holding member which extends over the at least two box flaps when the closure is in a closing position;

a means for connecting the first holding member and the second holding member which passes through a space between the two opposing flaps of the box; and wherein the first holding member, the second holding member, and the means for connecting are in an integral unit constructed separately from the box; and wherein the first holding member is longer than the second holding member in the lengthwise direction which is parallel to opposing edges of the opposing flaps of the box.

12. A box and box closure in accordance with claim 11, wherein the second holding member includes a means for holding a label.

13. A box and box closure in accordance with claim 11 wherein the first holding member is rectilinear in shape and extends a greater distance towards folds at a point where the flaps join sides of the box than the distance the second holding member extends towards the folds.

14. A box and box closure in accordance with claim 11 wherein the first holding member, the second holding member, and the means for connecting the first and second holding members are all formed together from a continuous material.

15. A box and box closure in accordance with claim 11 wherein the first holding member is flat on its bottom surface which prevents interference upon insertion of the closure over and below the two box flaps by a box flap which is transverse to the two opposing flaps.

16. A box and box closure in accordance with claim 11 wherein the second holding member has edges which are closer to the first holding member than a distance between the first and second holding members measured at the means for connecting, for gripping the two opposing flaps.

17. A box and box closure for holding opposing flaps of the box top in a closed position the improvement comprising:

a box having at least two opposing flaps;

a first holding member which extends below at least two box opposing flaps when the closure is in a closing position; and a second holding member which extends over the at least two box flaps when the closure is in a closing position;

a means for connecting the first holding member and the second holding member which passes through a space between the two opposing flaps of the box; and wherein a tapered leading edge is formed at a leading edge of the means for connecting between leading edges of the first and second holding member for facilitating insertion of the closure in the space between the two opposing box flaps.

18. A box and box closure in accordance with claim 17 wherein the second holding member includes a means for holding a label.

19. A box closure in accordance with claim 17 wherein the first holding member is rectilinear in shape and extends a greater distance towards folds at a point where the flaps join sides of the box than the distance the second holding member extends towards the folds.

20. A box and box closure in accordance with claim 17 wherein the first holding member, the second holding member, and the means for connecting the first and second holding members are all formed together from a continuous material.

21. A box and box closure in accordance with claim 17 wherein the first holding member is flat on its bottom surface which prevents interference upon insertion of the closure over and below the two box flaps by a box flap which is transverse to the two opposing flaps.

22. A box and box closure in accordance with claim 17 wherein the second holding member has edges which are closer to the first holding member than a distance between the first and second holding members measured at the means for connecting, for gripping the two opposing flaps.

* * * * *